US010323427B2

(12) United States Patent
Schmidt

(10) Patent No.: US 10,323,427 B2
(45) Date of Patent: Jun. 18, 2019

(54) ANCHORAGE DEVICE

(71) Applicant: Danmarks Tekniske Universitet, Kgs. Lyngby (DK)

(72) Inventor: Jacob Wittrup Schmidt, Copenhagen Ø (DK)

(73) Assignee: Danmarks Tekniske Universitet, Kgs. Lyngby (DK)

( * ) Notice: Subject to any disclaimer, the term of this patent is extended or adjusted under 35 U.S.C. 154(b) by 0 days.

(21) Appl. No.: 15/738,228

(22) PCT Filed: Jun. 24, 2016

(86) PCT No.: PCT/EP2016/064706
§ 371 (c)(1),
(2) Date: Dec. 20, 2017

(87) PCT Pub. No.: WO2016/207372
PCT Pub. Date: Dec. 29, 2016

(65) Prior Publication Data

US 2018/0187438 A1 Jul. 5, 2018

(30) Foreign Application Priority Data

Jun. 26, 2015 (EP) ..... 15174093

(51) Int. Cl.
*E04G 21/12* (2006.01)
*E04G 23/02* (2006.01)
*E04C 5/12* (2006.01)

(52) U.S. Cl.
CPC ..... *E04G 23/0218* (2013.01); *E04C 5/127* (2013.01); *E04C 5/122* (2013.01); *E04G 2023/0262* (2013.01)

(58) Field of Classification Search
CPC ..... E04G 23/0218; E04G 2023/0251; E04G 2023/0259; E04G 2023/0262; E04G 23/0229; E04H 12/2292
See application file for complete search history.

(56) References Cited

U.S. PATENT DOCUMENTS 1,905,405 A * 4/1933 Winslow ..... E04G 23/0203 52/514
6,389,766 B1 5/2002 Jackson
(Continued)

FOREIGN PATENT DOCUMENTS

AT 412564 B 4/2005
CN 101929221 A 12/2010
(Continued)

OTHER PUBLICATIONS

European Patent Office, International Search Report and Written Opinion in corresponding International Patent Application No. PCT/EP2016/064706, dated Aug. 25, 2016 (12 pages).

*Primary Examiner* — Gisele D Ford
(74) *Attorney, Agent, or Firm* — Nixon Peabody LLP

(57) ABSTRACT

An anchoring device configured for anchoring tendons for structural reinforcing a structure. The anchoring device includes fastening means configured for fastening the anchoring device to the structure, and a tendon pressure contact surface configured for being pressed against a surface of the tendon to be anchored. The tendon defines a reference plane, and anchoring device defines first and second distal end spaced apart from each other in a longitudinal direction. The anchoring device further includes a proximal portion located between the first and second distal ends. The anchoring device defines a core plane extending parallel to the reference plane. The tendon pressure contact surface extends in the longitudinal direction of the anchoring device from the first distal end to the proximal portion. The
(Continued)

tendon pressure contact surface converges in the longitudinal direction of the anchoring device from the proximal portion towards the first distal end in the direction towards the core plane, such that the distance between the tendon pressure contact surface and the core plane varies along the longitudinal direction of the anchoring device. The distance increases from the first distal end towards the proximal portion of the anchoring device.

19 Claims, 3 Drawing Sheets

(56) References Cited

U.S. PATENT DOCUMENTS 6,584,738 B1 * 7/2003 Andra ..... E04G 21/121 52/223.13
9,663,963 B2 * 5/2017 Berset ..... E04G 23/0218
2005/0247016 A1 * 11/2005 Andra ..... E04C 5/127 52/745.21
2005/0252116 A1 * 11/2005 Maier ..... E04C 5/085 52/223.1
2011/0000606 A1 * 1/2011 Al-Emrani ..... E04C 5/085 156/160
2011/0197540 A1 * 8/2011 Pantelides ..... E01D 19/16 52/698
2013/0087673 A1 * 4/2013 Mullins ..... F16M 13/027 248/343
2013/0316118 A1 * 11/2013 Harik ..... E04C 5/07 428/53
2015/0075101 A1 * 3/2015 Semaan ..... E04H 12/08 52/514

FOREIGN PATENT DOCUMENTS

EP 1033455 A1 9/2000
JP 2007-247197 A 9/2007

* cited by examiner

ANCHORAGE DEVICE

CROSS-REFERENCE TO RELATED APPLICATIONS

This application is a U.S. National Stage of International Application No. PCT/EP2016/064706, filed Jun. 24, 2016, which claims the benefit of European Patent Application No. 15174093.3, filed Jun. 26, 2015, both of which are incorporated herein by reference in their entireties.

The present invention to an anchoring device configured for anchoring one or more tendons for structural reinforcing a structure such as a concrete structure; said anchoring device comprises fastening means configured for fastening said anchoring device to said structure, said anchoring device comprises a tendon pressure contact surface configured for be pressed against a surface of the tendon to be anchored, said tendon defining a reference plane; said anchoring device defines a first distal end and a second distal end spaced apart from the first distal end in a longitudinal direction, said anchoring device further comprising a proximal portion located between the first and second distal ends; said anchoring device defines a core plane; said core plane extends parallel to said reference plane; said tendon pressure contact surface extending in the longitudinal direction of the anchoring device from said first distal end to said at least the proximal portion.

BACKGROUND OF THE INVENTION

Anchoring devices for anchoring tendons are well known and may take many forms. Likewise, it is well known to use anchoring devices for mechanical clamping or wedging tendons, such as steel tendons or fiber reinforced polymer (FRP) tendons for structural reinforcing a structure, such as a concrete structure. The anchoring devices typically anchor the steel or FRP tendons mechanically by using pressure and friction.

The strength properties of the FRP tendons fibers in the transverse direction is poor and the mechanical anchorage has to rely on friction using large compressive stresses from the anchoring device. This introduces high principal stresses acting on the tendons in the loaded end at the distal end of the anchorage device, where both tensile and compressive forces are represented, often resulting in premature failure of the tendons.

To overcome this problem, the general practice, when anchoring flat tendons having a rectangular or square cross-section, is to use a plate-shaped anchor which is tightened in situ by varying the forces of the bolts which clamp the tendons, such that bolts at the distal end of the anchor are tightened less, to reduce the compressive forces acting on the tendons and thereby decreasing the principal stresses acting on the tendon at the distal end of the anchoring device.

However this method is difficult to manage in a controlled way.

In many cases it is desirable to provide an anchorage device which is simple in construction but yet provide a controlled grip between the anchorage device and tendons.

BRIEF DESCRIPTION OF THE INVENTION

It is an object of the present invention to provide an anchorage device which provides an anchoring device which minimizes the risk of premature failure of the tendons.

This is achieved by an anchorage device, wherein said tendon pressure contact surface converges in the longitudinal direction of the anchoring device from the proximal portion towards the first distal end in the direction towards the core plane, such that the distance between the tendon pressure contact surface and the core plane varies along the longitudinal direction of the anchoring device, said distance increases from the first distal end towards the proximal portion of the anchoring device.

Hereby one or more tendons are wedged between the anchoring device and a structure, and as the compressive forces are reduced, the high principal stresses acting on the tendons in the loaded end at the distal end of the anchorage device are reduced, thus minimizing the risk of rupture of the tendons.

In an embodiment, said wherein the tendon pressure contact surface comprises a planar surface in transverse direction of the longitudinal extension of the anchoring device.

Hereby a maximum width of surface for actively providing a pressure on the one or more tendons is provided.

In an embodiment, said tendon pressure contact surface extends from said first distal end to said second distal end, said tendon pressure contact surface converges in the longitudinal direction of the anchoring device from the proximal portion towards the first and second distal end in the direction towards the core plane, such that the distance perpendicular to the longitudinal direction of the anchoring device between the tendon pressure contact surface and the core plane is varying along the length of the anchoring device, said distance increases from the first and second distal end towards the proximal portion of the anchoring device.

In an embodiment, the distance increases from said first and second distal ends towards the proximal portion in an extension of at least ⅕-⅐ of the length of the anchoring device.

In an embodiment, the tendon pressure contact surface comprises a convex shaped surface in the longitudinal direction.

In an embodiment, the anchoring device comprises two abutting fastening portions positioned at the periphery along the length of said anchoring device adjacent said contact surface and said abutting fastening portion comprises said fastening means.

In an embodiment, the abutting fastening portion comprises a flange configured for enclosing one or more tendons, and said flange extends in a direction perpendicular to said core plane.

In an embodiment, said flange comprises a contact surface configured for abut against the surface of said structure; said contact surface extends parallel to said core plane.

In an embodiment, said fastening means constitutes through going apertures positioned in said fastening portions, said through going holes extends perpendicular to said core plane.

In an embodiment, said length of said anchoring device is up to 1.5 meters.

In another embodiment, a first portion of the surface of the structure is configured for back stop of the anchoring device such that the tendon support surface are wedged between said anchoring device and said structure.

In an embodiment, a second portion of the surface of said structure is configured for provide counter pressure for the contact surface of said anchoring device.

In an embodiment, said first and second portion of the surface of the structure defines two planes which are parallel or positioned in the same plane.

BRIEF DESCRIPTION OF THE DRAWINGS

Embodiments of the invention will be described in the following with reference to the drawings wherein.

DETAILED DESCRIPTION OF THE INVENTION WITH REFERENCE TO THE FIGURES

The present invention relates to an anchoring device (10) configured for anchoring tendons (50) such as flat tendons, for structural reinforcing a structure (60) such as a concrete structure.

When relative expressions such as "height" and "width" and "horizontal" or similar are used in the following terms, these only refer to the appended figures and not to an actual situation of use. The shown figures are schematic representations for which reason the configuration of the different structures as well as their relative dimensions are intended to serve illustrative purposes only.

In that context it may be convenient to define that the term "distal end" in the appended figures is meant to refer to the two ends of the anchoring device, whereas the term "proximal portion" is meant to refer to the intermediate portion of the anchoring device located between the two distal ends.

The term "longitudinal direction" is the direction defined by the extension of the tendon to be anchored. The longitudinal direction of the anchoring device is defined as the extension of the anchoring device in the direction from the first to the second distal ends (16,17).

Figure 1:
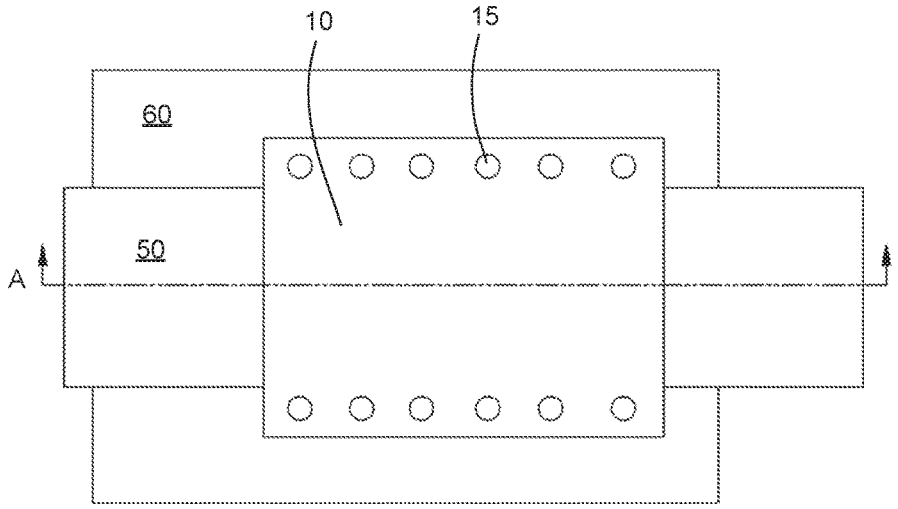
FIG. 1 is a top view of the anchoring device.

As illustrated in FIG. 1, the anchoring device (10) comprises fastening means (15) configured for fastening the anchoring device (10) to a structure (60), thereby the anchoring device is capable of wedging a tendon (50) against the surface of the structure (60).

The anchoring tendon (50) constitutes flat tendon comprising a rectangular cross-section or square cross-section. The surface of the structure (60) provides counter pressure for the wedging of the tendon (50).

Figure 2:
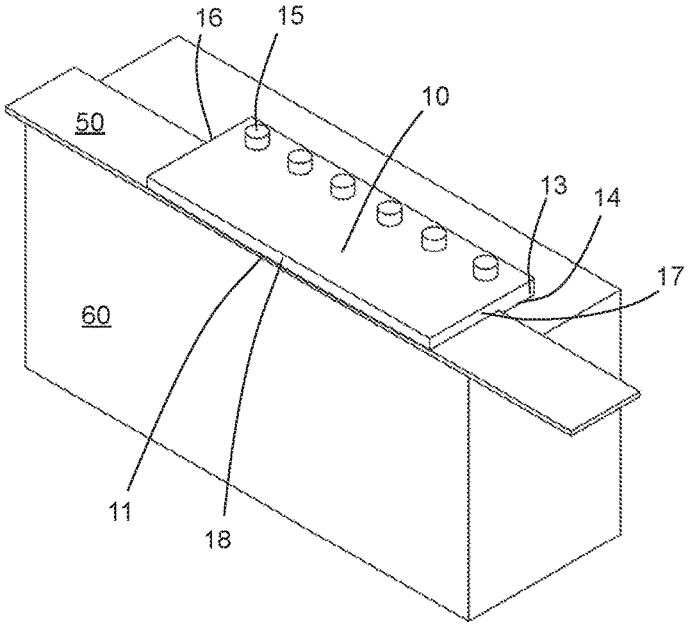
FIG. 2 is a perspective longitudinal cross-sectional view of a structure and the anchoring device clamping a tendon to the structure.

The anchoring device (10), as illustrated in FIG. 2, comprises a first distal end (16) and a second distal end (17) and a proximal portion (18) located intermediate the first and second distal ends (16,17). The anchoring device comprises a tendon pressure contact surface (11), which extends from the first distal end (16) to the second distal end (17) along the length of the anchoring device (10).

The anchoring device (10) comprises a flange (13) which is positioned along the length adjacent the tendon pressure contact surface (11). The flange (13) comprises a contact surface (14) and fastening means (15), when the anchoring device is fastened to the structure (60) by fastening means (15), which is illustrated by the contour of a blot/nut, the contact surface (14) abuts against the surface of said structure (60), thereby enclosing the tendon (50) being clamped between said anchoring device (10) and said structure (60).

Figure 3:
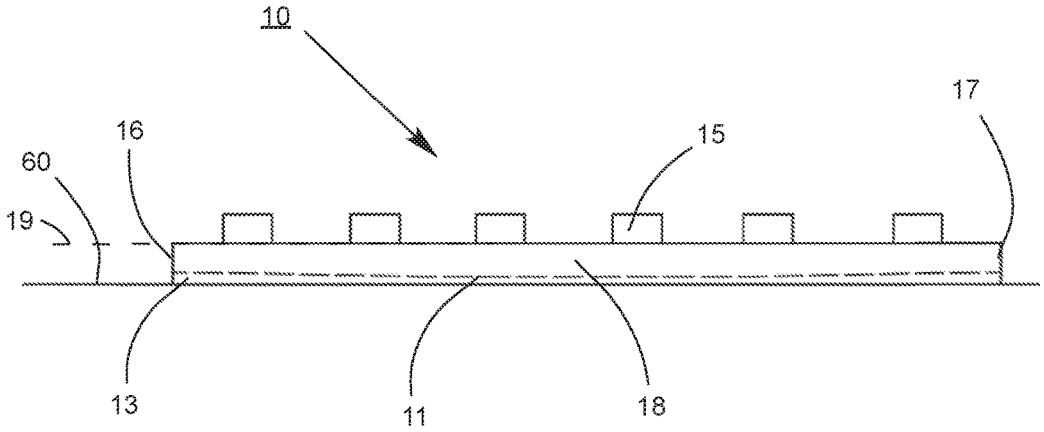
FIG. 3 is a side view of the anchoring device.

FIG. 3 shows a side view of the embodiment shown in FIG. 2.

The anchoring device (10) comprises a core plane (19) which represents a horizontal plane extending parallel to the extent of the tendon. In the figures the core plane (19) coincide the upper surface of the anchoring device.

The flange (13) extends perpendicular to the core plane (19), and the contact surface (14) extends parallel to the core plane (19). The distance normal to the core plane (19), between the tendon pressure contact surface (11) and the core plane (19), varying along the length of the anchoring device (10).

Likewise, the distance between the tendon pressure contact surface (11) and the contact surface (14) vary along the longitudinal direction of the anchoring device.

In the longitudinal direction of the anchoring device, the tendon pressure contact surface (11) comprises an inclined shaped surface. At the proximal portion (18) the distance is greatest between the tendon pressure contact surface (11) and the core plane (19), and the tendon pressure contact surface (11) converges from the proximal portion (18) towards the distal ends (16,17) in a direction towards the core plane (19), such that the distance between the core plane (19) and the tendon pressure contact surface (11) is smallest at the distal ends (16,17). Hereby the tendon pressure surface (11) provides a varying transversal pressure along the length of the anchoring device (10).

The converging surface of the tendon pressure surface (11) is configured for providing a non-uniform transversal pressure along the length of the anchoring device, such that the tendon pressure contact surface (11) provides the least transversal pressure at the first and second distal ends (16,17) of the anchoring device (10) and an increasing transversal pressure from the first distal end (16) towards the proximal portion (18) of the anchoring device (10).

Figure 4:
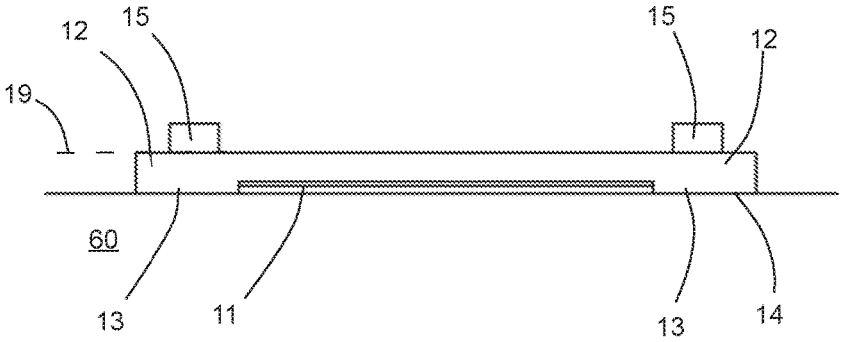
FIG. 4 is an end view of the anchoring device.

The tendon pressure contact surface (11) comprises a planar surface in transverse direction of the longitudinal extension of the anchoring device (10) as illustrated in FIGS. 2 and 4. Thus the anchoring device forms an indentation for accommodate the tendon, where the indentation has a rectangular cross-section varying in height alone the length of the anchoring device (10) having the greatest height at the distal ends (16,17) and the lowest height at the proximal portion (18).

FIG. 4 illustrates the anchoring device in an end view. The anchoring device (10) comprises two abutting fastening portions (12) positioned at the periphery along the length of said anchoring device adjacent said contact surface (11). The two abutting fastening portions (12) comprise fastening means (15) and the flange (13).

A tendon, when wedged by the anchoring device, is encircled by the tendon pressure contact surface (11), the two flanges (13) positioned adjacent the tendon pressure contact surface (11) along the length of the anchoring device and the structure (60). The size of the flanges determines the distance between the tendon pressure contact surface (11) and the structure (60).

The distance between the tendon pressure contact surface (11) and the structure (60) is varying along the length of the anchoring device due to the inclined tendon pressure contact surface (11).

The flange (13) comprises a height which is less than the height of the tendons (50) and comprises a contact surface (14) which abuts against the surface of said structure (60), when anchoring a tendon.

The extent of the tendon pressure contact surface (11) in the direction perpendicular of the extension of the anchoring device is larger or corresponds to the width of the tendons.

Figure 5:
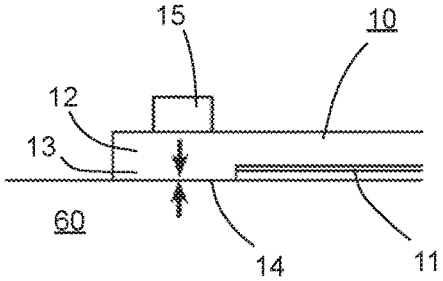
FIG. 5 is a partial end view.

FIG. 5 illustrates a similar view to that of FIG. 4, and illustrates that the fastening means (15) provide a transversal pressure and the structure (60) provides a counter pressure. The forces are illustrated by arrows. Thus, a tendon is wedged between the tendon pressure contact surface (11) of the anchoring device and the plane surface of the structure (60).

The anchoring device clamps the tendon mechanically using pressure and friction. However, the anchoring device and the tendon may additionally be bonded by the use of an adhesive.

FIGS. 6*a*-6*d* is schematic longitudinal cross-sectional views of the anchoring device comprising different shaped embodiments of the tendon pressure contact surface (11). The different embodiments of the tendon pressure contact surface (11) provide different force distribution profiles.

Figure 6A:
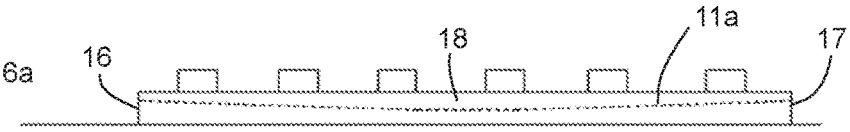
FIG. 6*a*-6*d* is a schematic longitudinal cross-sectional view of the anchoring device.

FIG. 6*a* illustrates that the tendon pressure contact surface (11) is linearly inclined from a maximum height for the tendon between the structure and the tendon pressure contact surface (11) at the first and second distal ends (16,17) to one or more points at the proximal portion (18), where the tendon pressure contact surface (11) has a plane horizontal surface. Likewise, FIG. 6*a* illustrates that the tendon pressure contact surface (11) comprises the smallest distance to the core plane (19) at the first and second distal ends (16,17) and the greatest distance to the core plane (19) at the proximal portion (18).

Thus, the surface comprises a linear surface decreasing the distance between the structure (60) and the tendon pressure contact surface (11), a horizontal linear portion which creates a constant distance at the proximal portion (18), and the surface comprises a linear surface increasing the distance between the structure (60) and the tendon pressure contact surface (11).

Figure 6B:
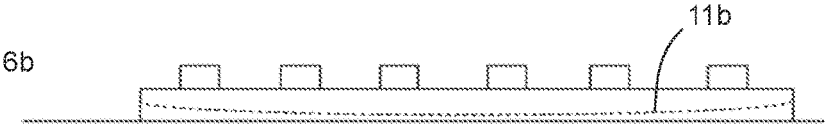

In FIG. 6*b* the tendon pressure contact surface (11) has a similar shape as illustrated in FIG. 6*a* except that the surface is curved instead of linear, where the tendon pressure contact surface (11) converging from the distal ends (16,17) having the smallest distance to the core plane (19), the tendon pressure contact surface (11) converging towards the proximal portion (18), where the distance to the core plane (19) is greatest. The tendon pressure contact surface (11) provides a convex shape in the longitudinal extension of the anchoring device, and a variable anchoring pressure on a tendon along the length of the anchoring device is provided.

Tendon pressure contact surface (11) extends from said first distal end (16) to said second distal end (17), said tendon pressure contact surface (11) converges in the longitudinal direction of the anchoring device from the proximal portion (18) towards the first and second distal ends (16,17) in the direction towards the core plane (19), such that the distance between the tendon pressure contact surface (11) and the core plane (19) is varying along the length of the anchoring device, said distance increases from the first and second distal ends (16,17) towards the proximal portion (18) in an extension of ⅕-⅐ of the length of the anchoring device (10).

The anchoring device according to the invention provides the smallest pressure at the first and the second distal ends (16,17), and the greatest pressure at the proximal portion (18) of the anchoring device (10).

Figure 6C:
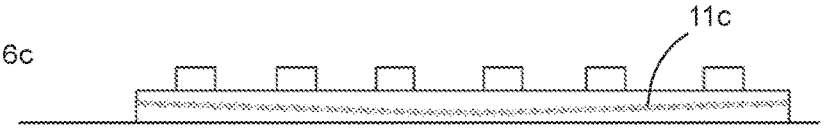
Figure 6D:
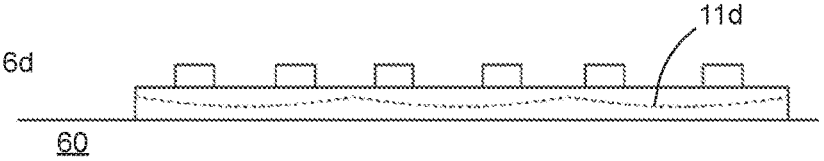

FIG. 6*c* schematically illustrates by x that the tendon pressure contact surface is rough in order to provide additional friction between the tendon and the anchoring device.

Figure 7:
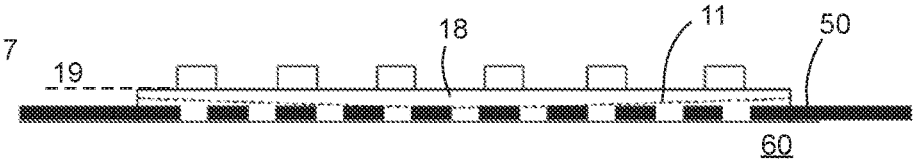
FIG. 7 is a schematic longitudinal view of the cross-sectional view of the anchoring device and a tendon.

FIG. 7 illustrates a tendon (50) which due to the variable distance between the tendon pressure contact surface (11) and the core plane (19) the tendon is clamped by transversal forces at the most at the proximal portion (18) and gradually less towards the first and second distal ends (16,17). The anchoring device may be designed to avoid the clamping effect at the first and second distal ends (16,17).

Figure 8:
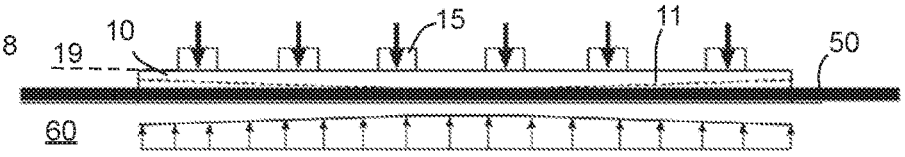
FIG. 8 is a schematic longitudinal view of the anchoring device illustration transversal pressure forces.

FIG. 8 illustrates schematically the fastening forces acting on a tendon (50) which is wedged between the anchoring device (10) and the structure (60).

The force distribution profile is illustrated by arrows.

The structure (60) provides a non-uniform counter pressure, due to the varying distance between the core plane (19) and tendon pressure contact surface (11). It is illustrated that the anchoring device provides the least transversal pressure at the first and the second distal ends (16,17), and the greatest pressure at the proximal portion (18) of the anchoring device (10).

The figures illustrate an anchoring device (10) configured for anchoring one or more flat tendons (50) for structural reinforcing a structure (60) such as a concrete structure, said anchoring device (10) comprises fastening means (15) configured for fastening said anchoring device (10) to said structure (60), said anchoring device (10) comprises a tendon pressure contact surface (11), a first distal end (16) and a second distal end (17) and a proximal portion (18), said tendon pressure contact surface (11) extending in the longitudinal direction of the anchoring device (10) from said first distal end (16) to said second distal end (17) wherein said tendon pressure contact surface (11) converges in the longitudinal direction of the anchoring device from the proximal portion (18) towards the first and second distal ends (16,17) in the direction towards the core plane, such that the tendon pressure surface (11) is configured for providing a variable transversal pressure along the length of the anchoring device providing the smallest transversal pressure at the first and second distal ends (16,17) of the anchoring device (10) and an increasing transversal pressure from the first and second distal ends (16,17) towards the proximal portion (18) of the anchoring device (10) in an extension of at least ⅕ of the length of the anchoring device.

The anchoring device may be manufactured by non-corrosive or corrosive materials. In an embodiment, the anchoring device may be manufactured in aluminum, aluminum bronze or aluminum zinc.

The invention claimed is:

1. An anchoring device configured for anchoring a flat tendon for structurally reinforcing a structure; said anchoring device comprises fastening means configured for fastening said anchoring device to said structure, said anchoring device comprises a tendon pressure contact surface configured for pressing a surface of the tendon to be anchored against a surface of said structure, said flat tendon defining a reference plane, said flat tendon having opposite sides; said anchoring device defines a first distal end and a second distal end spaced apart from the first distal end in a longitudinal direction and a length in said longitudinal direction, said anchoring device further comprising a proximal portion located between the first and second distal ends; said anchoring device defines a core plane coinciding with an upper surface of the anchoring device; said core plane extends parallel to said reference plane; said tendon pressure contact surface extending in the longitudinal direction of the anchoring device from said first distal end to at least said proximal portion, wherein said tendon pressure contact surface converges in the longitudinal direction of the anchoring device from the proximal portion towards the first distal end in a direction towards the core plane, such that a distance between the tendon pressure contact surface and the core plane varies along the longitudinal direction of the anchoring device, said distance increases from the first distal end towards the proximal portion of the anchoring device, such that compressive forces on the tendon are reduced at the first or second distal ends.

2. The anchoring device according to claim 1, wherein the tendon pressure contact surface comprises a planar surface in a transverse direction of the longitudinal direction of the anchoring device.

3. The anchoring device according to claim 1, wherein said tendon pressure contact surface extends from said first distal end to said second distal end, said tendon pressure contact surface converges in the longitudinal direction of the anchoring device from the proximal portion towards the first and second distal ends in the direction towards the core plane, such that the distance between the tendon pressure contact surface and the core plane is varying along the length of the anchoring device, said distance increases from the first and second distal ends towards the proximal portion of the anchoring device.

4. The anchoring device according to claim 3, wherein the distance increases from said first and second distal ends towards the proximal portion in an extension of ⅕ to ⅐ of the length of the anchoring device.

5. The anchoring device according to claim 1, wherein the tendon pressure contact surface comprises a convex shaped surface in the longitudinal direction.

6. The anchoring device according to claim 1, wherein the anchoring device comprises an abutting fastening portion positioned at a periphery of the anchoring device along the length of said anchoring device and adjacent said tendon pressure contact surface and where said fastening means are arranged at said abutting fastening portion.

7. The anchoring device according to claim 6, wherein the abutting fastening portion comprises a flange extending in a direction perpendicular to said core plane.

8. The anchoring device according to claim 7, wherein said flange comprises a contact surface configured for abutting against a surface of said structure, and wherein said contact surface extends parallel to said core plane.

9. The anchoring device according to claim 6, wherein said fastening means comprises through-going apertures positioned in said fastening portion, said through-going apertures extending perpendicular to said core plane.

10. The anchoring device according to claim 1, wherein said length of said anchoring device is up to 1.5 meters.

11. The anchoring device according to claim 1, wherein at least part of the anchoring device is manufactured with aluminum.

12. A structure comprising the anchoring device according to claim 1, wherein a first portion of the surface of a structure is configured for back stopping of the anchoring device such that the opposite sides of the tendon are wedged between said anchoring device and said structure.

13. The structure according to claim 12, wherein a second portion of the surface of said structure is configured for providing counter pressure for the tendon pressure contact surface of said anchoring device.

14. The structure according to claim 13, wherein said first and second portions of the surface of the structure define two planes which are parallel or coplanar.

15. The anchoring device according to claim 1 used for anchoring a tendon for structural reinforcing a structure.

16. The anchoring device according to claim 2, wherein said tendon pressure contact surface extends from said first distal end to said second distal end, said tendon pressure contact surface converges in the longitudinal direction of the anchoring device from the proximal portion towards the first and second distal ends in the direction towards the core plane, such that the distance between the tendon pressure contact surface and the core plane is varying along the length of the anchoring device, said distance increases from the first and second distal ends towards the proximal portion of the anchoring device.

17. The anchoring device according to claim 3, wherein the tendon pressure contact surface comprises a convex shaped surface in the longitudinal direction.

18. The anchoring device according to claim 3, wherein the anchoring device comprises an abutting fastening portions positioned at a periphery of the anchoring device along the length of said anchoring device and adjacent to said tendon contact surface, and wherein said fastening means are arranged at said abutting fastening portion.

19. The anchoring device according to claim 2, wherein the anchoring device comprises an abutting fastening portion positioned at the periphery of the anchoring device along the length of said anchoring device and adjacent to said contact surface, where said fastening means are arranged at said abutting fastening portion, and wherein said fastening means comprises through-going apertures positioned in said fastening portions, said through going apertures extending perpendicular to said core plane.

* * * * *